US009743770B1

(12) United States Patent
Pollard et al.

(10) Patent No.: US 9,743,770 B1
(45) Date of Patent: Aug. 29, 2017

(54) MULTI-POSITIONING RECLINER CHAIR

(71) Applicant: Golden Technologies, Inc., Old Forge, PA (US)

(72) Inventors: W. Edward Pollard, Falls, PA (US); James Olcheski, Duryea, PA (US)

(73) Assignee: Golden Technologies, Inc., Old Forge, PA (US)

( * ) Notice: Subject to any disclaimer, the term of this patent is extended or adjusted under 35 U.S.C. 154(b) by 227 days.

(21) Appl. No.: 14/504,254

(22) Filed: Oct. 1, 2014

Related U.S. Application Data

(60) Provisional application No. 61/885,327, filed on Oct. 1, 2013.

(51) Int. Cl.
*A47C 1/024* (2006.01)

(52) U.S. Cl.
CPC ..... *A47C 1/024* (2013.01)

(58) Field of Classification Search
CPC ..... A47C 1/024
USPC ..... 297/85 M
See application file for complete search history.

(56) References Cited

U.S. PATENT DOCUMENTS

| | | | |
|---|---|---|---|
| 3,016,264 | A | 1/1952 | Hughes |
| 3,743,348 | A | 7/1973 | Sloan |
| 4,007,960 | A | 2/1977 | Gaffney |
| 4,365,836 | A | 12/1982 | Jackson et al. |
| 4,386,803 | A | 6/1983 | Gilderbloom |
| 4,852,939 | A | 8/1989 | Krauska |
| 5,013,084 | A | 5/1991 | May |
| 5,061,010 | A | 10/1991 | LaPointe |
| 5,165,753 | A | 11/1992 | Henderson |
| 5,265,935 | A | 11/1993 | Geisler et al. |
| 5,312,153 | A | 5/1994 | Lin |
| 5,354,116 | A | 10/1994 | May et al. |
| 5,498,055 | A | 3/1996 | Goldman |
| 5,520,439 | A | 5/1996 | Blount |
| 5,582,457 | A | 12/1996 | Komorowski et al. |
| 5,651,580 | A | 7/1997 | LaPointe et al. |
| 5,806,920 | A | 9/1998 | Blount |
| 5,845,961 | A | 12/1998 | LaPointe et al. |
| 6,000,758 | A | 12/1999 | Schaffner et al. |
| 6,022,076 | A | 2/2000 | Samson |
| 6,135,559 | A | 10/2000 | Kowalski |
| 6,142,558 | A | 11/2000 | May |

(Continued)

FOREIGN PATENT DOCUMENTS

| | | |
|---|---|---|
| DE | 9420149 U1 | 2/1995 |
| GB | 2030854 | 4/1980 |

(Continued)

*Primary Examiner* — Anthony D Barfield
(74) *Attorney, Agent, or Firm* — Clinton H. Wilkinson; Charles A. Wilkinson

(57) ABSTRACT

A lift and recliner chair which is positionable in multiple reclining positions including both a Trendelenburg and zero-gravity position, in which using an electronic actuator mechanism the position of the back frame can be adjusted to any lift and/or reclining position the chair is capable of achieving without requiring any movement or adjustment to the position of the seat frame or footrest. The back frame actuator mechanism is secured between the back frame and a stationary position on the lift/recline frame, and has an increased stroke length and is synchronized with a separate lift/recline actuator to maintain the back frame in the same relative position with respect to the seat frame as the chair is moved to and from a reclining position.

12 Claims, 10 Drawing Sheets

(56) References Cited

U.S. PATENT DOCUMENTS

| | | | |
|---|---|---|---|
| 6,213,554 | B1 | 4/2001 | Marcoux et al. |
| 6,557,940 | B2 | 5/2003 | Hayashi et al. |
| 6,659,556 | B2 | 12/2003 | Pellerin |
| 6,726,276 | B1 | 4/2004 | Tholkes et al. |
| 6,840,575 | B2 | 1/2005 | Hesse |
| 6,846,042 | B2 | 1/2005 | Hanson et al. |
| 7,543,885 | B2 | 6/2009 | Pollard et al. |
| 8,403,409 | B2 | 3/2013 | Pollard et al. |
| 8,459,733 | B2 | 6/2013 | Hoffman et al. |

FOREIGN PATENT DOCUMENTS

| | | |
|---|---|---|
| GB | 2407493 | 4/2005 |
| WO | 02087389 | 11/2002 |

MULTI-POSITIONING RECLINER CHAIR

FIELD OF THE INVENTION

The present invention relates to lift and reclining chairs, and more particularly to lift and reclining chairs having a back frame which is adjustable using an electronic control independent of the seat frame and footrest.

BACKGROUND OF THE INVENTION

Lift and recline chairs typically comprise a floor support or base section, a chair structure that includes at least a seat section, a back section, and a footrest section, which components are usually pivotally connected together by any number of different linkage arrangements, and a lift-recline mechanism connecting between the floor support and chair structure for moving the chair between a raised lift position and a reclining position. The use of one or more separate electronic actuators to control the movements of the lift-recline mechanism and adjust the position of the chair structure is known. Until recently, however, there was no ability to adjust the angle or incline of the chair back or back section to any desired position within the range of motion allowed by the chair back actuator without requiring or resulting in the position of another component of the chair structure, primarily the seat frame or footrest, to also be moved or adjusted. This is because movement of one or more parts of the back frame actuator mechanism was impeded or obstructed by other parts or components of the chair. Therefore, despite the use of a separate chair back actuator, the position adjustability of the back frame was still limited.

In U.S. Pat. No. 7,543,885 and its related patent documents, all of which are owned by the Applicant, an arrangement is disclosed by which the position or angle of the back frame is adjustable without requiring movement of the seat frame or other chair components except for those components and linkages connecting the back frame and back frame actuator to the chair assembly. This was accomplished by connecting the back frame actuator between the back frame and the seat frame or a component that moves or travels with the seat frame as its position is adjusted using a separate actuator. Such arrangement allows the back frame actuator connection to in effect follow the movements of the seat frame as its position is adjusted, while the position of the back frame actuator in relation to the seat frame remained essentially unchanged.

None of these arrangements for connecting the back frame actuator to the chair assembly allowed the back frame actuator to be connected to the lift frame of the chair, however, or to other components of the chair assembly that do not travel or follow the movements of the seat frame, since movement of the chair into a lift position required the relative position of or distance between the components of the lift frame with respect to the back section to vary. Provision of an economical arrangement by which the back frame actuator is connected between the back frame and the lift frame or base while still allowing for independent movement of the back frame in any position was not thought to be possible due to the complex movements of these components in relation to the back frame. The present inventors have nevertheless unexpectedly discovered that by precisely and simultaneously controlling the movements and position of the lift/recline and back frame actuators, the back frame actuator can be connected between the back frame and lift frame or base while still allowing the chair assembly to be reclined into any reclining position, including the so-called Trendelenburg and zero gravity positions.

OBJECTS OF THE INVENTION

It is therefore a primary object of an embodiment of the invention to provide a combination lift chair and reclining chair in which the chair is movable from a sitting or upright position to either a lift position or a reclining position.

It is a further object of an embodiment of the invention to provide a combination lift chair and Trendelenburg chair.

It is a still further object of the invention to provide a lift chair having an independently operating back in which the operating motor or actuator for the back in an embodiment is connected between the back frame and a section of the lift frame that remains stationary while the seat frame is moved.

It is a still further object of an embodiment of the invention to provide a lift and reclining chair that can achieve both a Trendelenburg reclined position and a zero-gravity reclined position.

It is a still further object of an embodiment of the invention to provide a lift and reclining chair having an independently positionable back frame and a linkage mechanism that is strong and durable and stable enough to withstand repeated use over time.

Still other objects and advantages of the invention will become clear upon review of the following detailed description in conjunction with the appended drawings.

SUMMARY OF THE INVENTION

A lift chair and recliner is provided having at least two independent electronic actuators operably connected to the chair such that the chair can be moved between an upright or seated position, a reclining position which may be a Trendelenburg or legs elevated with respect to the heart position or a zero gravity position, and a lift position in which the chair assembly is tilted forwardly and lifted upwardly to a position for aiding users to comfortably sit in and leave the chair with less physical exertion being required. The actuator for adjusting the incline or angle of the back frame is connected by linkages in one embodiment between the seat frame and lift frame, and is able to pivot the back frame within a full range of motion provided by the actuator, without requiring movement of the seat frame or footrest. This is made possible by providing that when the lift/recline actuator is operated to move the chair between a seated or upright position to a reclining position, in order to compensate for distances the seat frame is moved either rearwardly and/or upwardly in relation to the lift frame during such reclining operation, the back frame actuator is synchronously activated to extend or retract the actuator spindle a distance equal to the amount of movement of the seat frame in relation to the lift frame. In a preferred embodiment, the lift/recline actuator and back frame actuator are operably connected and controllable by a hand control device, and an integrated circuit is controlled by a programmed solid state device to allow for simultaneous activation and synchronized movement of the lift/recline actuator and back frame actuator as is necessary. By enabling the stroke length of the back frame actuator to be adjusted as the lift/recline actuator is operated, the back frame actuator can be connected between the back frame and various stationary positions on the lift frame or base. In one embodiment of the invention, the back frame actuator is pivotably connected between a bar member rigidly connected to the back frame and a connector attached to an upright C-shaped bar member of the lift frame.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
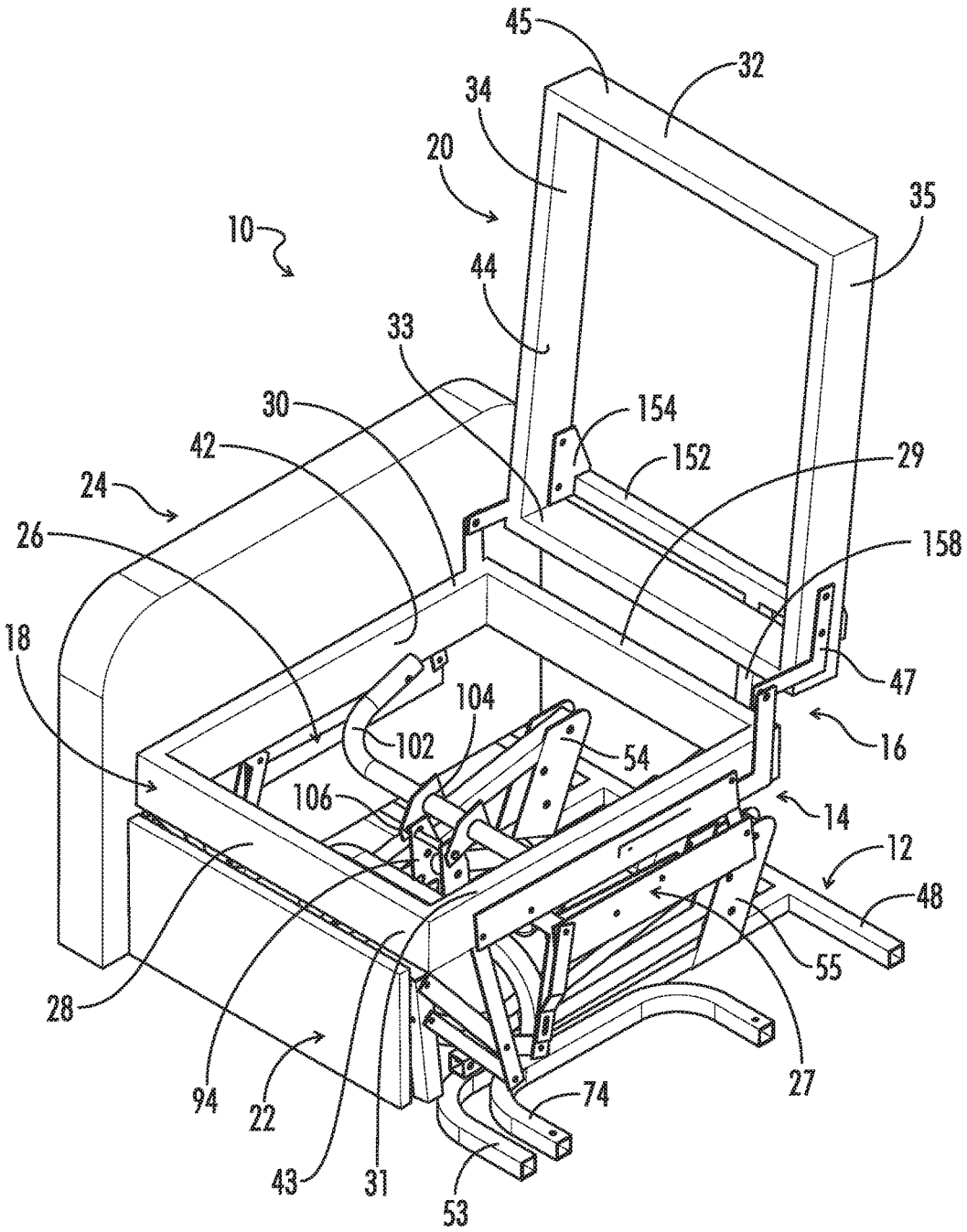
FIG. 1 is a perspective view of the internal components of a lift and recline chair in accordance with the invention in an upright position with one of the arm frames and upholstery removed.

Referring now to the drawings, in which like numerals are used to designate like or corresponding parts throughout the various figures, FIG. 1 is a perspective view of an embodiment of a lift and recliner chair 10 in accordance with the invention in an upright position, with the left arm frame, from the point of view of a chair occupant, and all of the upholstery removed to illustrate the internal chair components and lift/recline mechanism underneath. Chair 10 generally includes a base frame 12, a lift and recline assembly 14 which is secured to the base frame 12 (see also FIGS. 4-6), and a chair assembly 16 which is attached to the lift and recline assembly 14. Chair assembly 16 generally includes a seat frame 18, a back frame 20, a footrest 22, a pair of arm frames 24, only one of which is shown, and recliner mechanisms 26 and 27.

Figure 2:
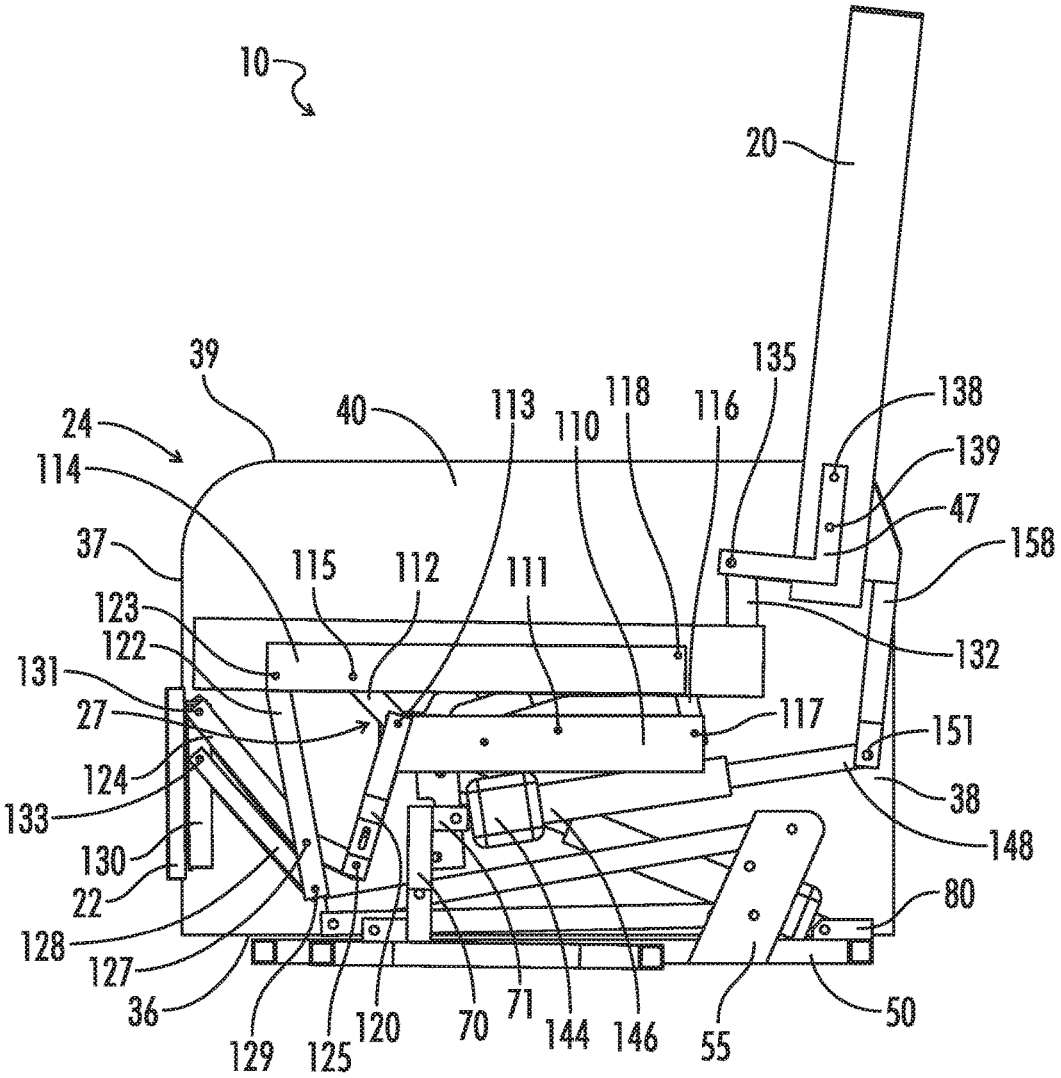
FIG. 2 is a side elevation view of the chair in the position shown in FIG. 1.

Seat frame 18 includes a front cross member 28, rear cross member 29, and a pair of side members 30 and 31 joining between front and rear cross members 28 and 29. Similarly, back frame 20 includes an upper cross member 32, a lower cross member 33 and a pair of side members 34 and 35 joining between upper and lower cross members 32 and 33. The front, rear, side, upper and lower members of seat frame 18 and back frame 20 in one embodiment are made of wood, and are stapled, nailed, or otherwise secured together such as by brackets, spiked wood connectors, fasteners or the like to form generally rectangular seat and back frame structures. In one embodiment, side members 34 and 35 of back frame 20 have a greater width near lower cross member 33 in order to increase the strength of the lower end of the back frame 20. As best shown in FIG. 2, arm frames 24 in the exemplary embodiment include an underside or lower surface 36, a front post 37, a rear post 38, an arm rest 39 extending between said front and rear posts, and side section 40 which connects between bottom section 36, front post 37, and rear post 38. In one embodiment, the arm frames 24 also have a wooden construction, and in other embodiments may have different configurations depending upon the particular chair design.

Footrest 22 in the exemplary embodiment has a generally rectangular profile and is also preferably made of wood. Seat frame 18 includes an inwardly facing surface 42 and an outwardly facing surface 43, and back frame 20 also has in a similar manner an inwardly facing surface 44 and an outwardly facing surface 45. Recliner mechanism 26 is secured to the outwardly facing surface 43 of seat frame side member 30, while mirror image recliner mechanism 27 is secured to the outwardly facing surface 43 of seat frame side member 31. In the illustrated embodiment, recliner mechanisms 26 and 27 are also connected directly by one or more linkages to footrest 22 and arm frames 24, and indirectly as described in greater detail below to back frame 20 by pivotable links 47, resulting in an interconnected chair assembly 16.

Figure 4:
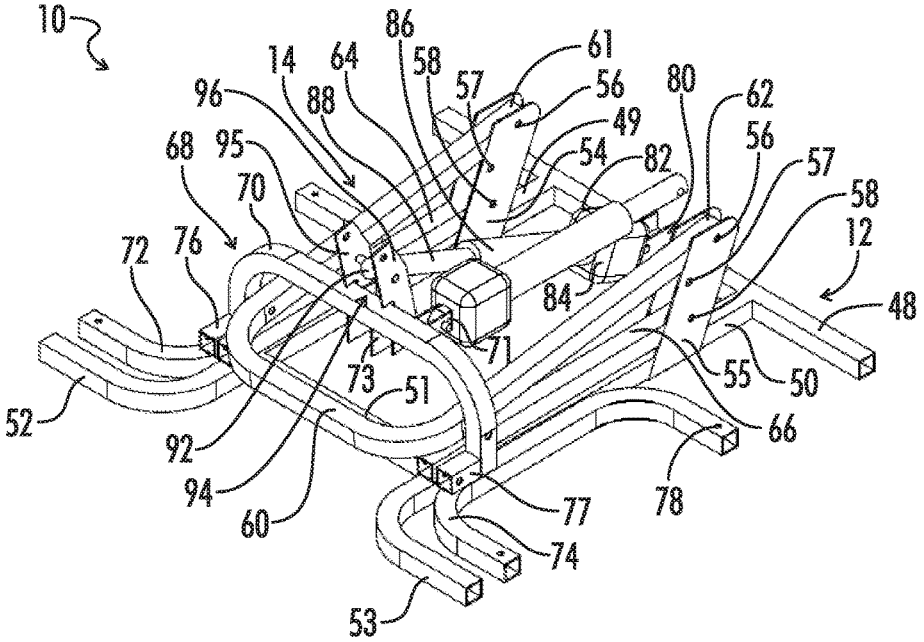
FIG. 4 is a perspective view of an exemplary chair lift and recline assembly.
Figure 5:
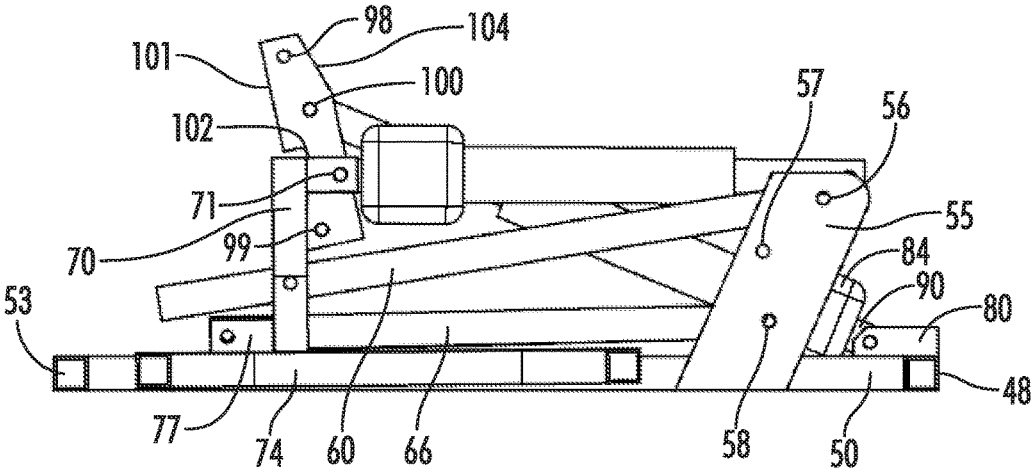
FIG. 5 is a side elevation view of the chair lift and recline assembly shown in FIG. 4.
Figure 6:
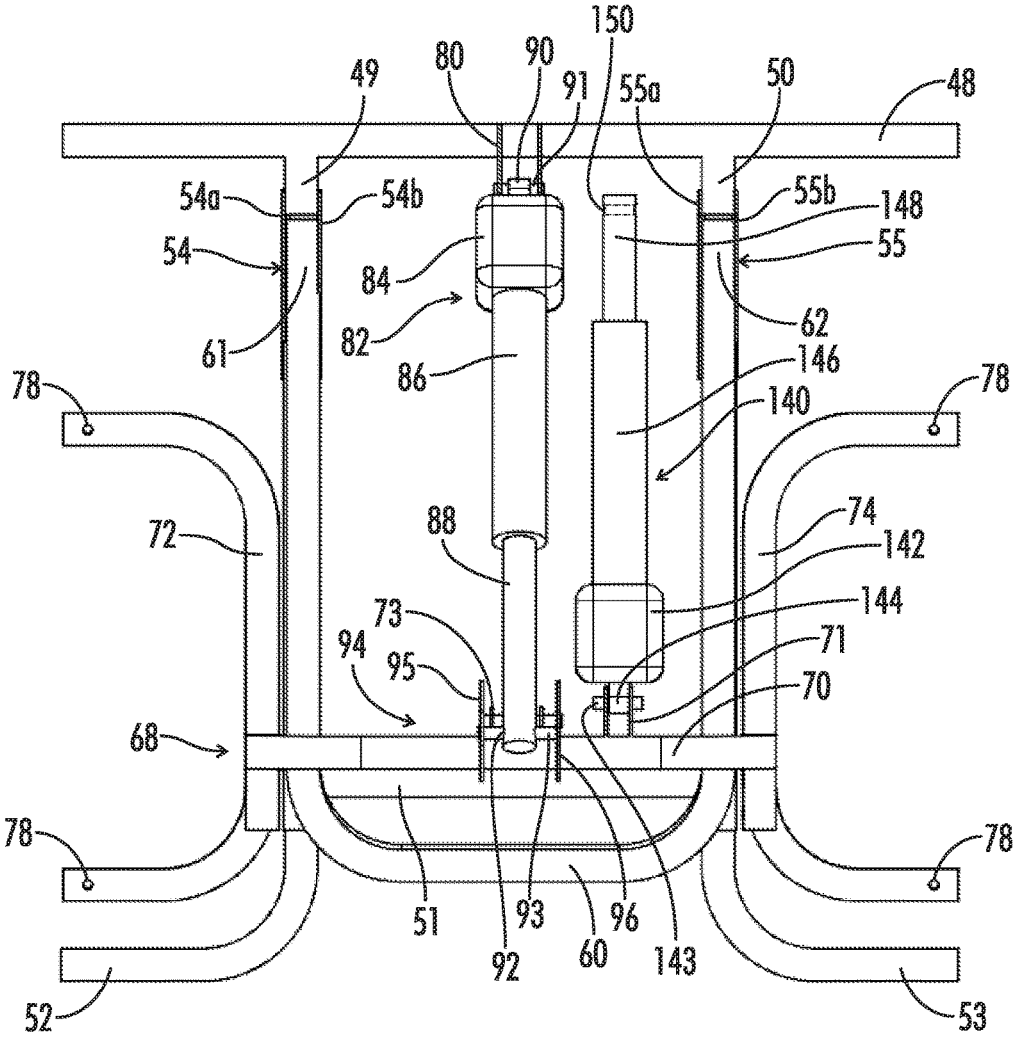
FIG. 6 is a top view of the chair lift and recline assembly shown in FIGS. 4 and 5.

Referring now in particular to FIGS. 4-6, base frame 12 includes a rear crossbar 48, spaced apart parallel bars 49 and 50 connected to and extending forwardly from rear crossbar 48, and front crossbar 51 which connects between parallel bars 49 and 50 at a position spaced apart from rear crossbar 48. Forward ends 52 and 53 of parallel bars 49 and 50 curve outwardly towards the perimeter of the chair, which gives base frame 12 a wider base and sufficient stability to support lift and recline assembly 14 as well as chair assembly 16 when in a normal seated position, moved into a raised or lift position, or in any possible reclining positions. Crossbars 48 and 51 and parallel bars 49 and 50 in one embodiment are made of hollow rectangular steel bars which are welded together at appropriate points to form a rigid structure. One or more foot members (not shown) may also be provided on the underside of rear crossbar 48 and on the forward ends 52 and 53 of parallel bars 49 and 50, or at any other desired location.

Matching upwardly oriented and aligned brackets 54 and 55 are connected to parallel bars 49 and 50, respectively, at a position near rear crossbar 48. In the embodiment shown, brackets 54 and 55 are each formed of a pair of spaced-apart plates (54*a-b* and 55*a-b*—see FIG. 6) which are preferably welded to opposite sides of parallel bars 49 and 50, respectively. Each bracket 54 and 55 has several aligned spaced apart apertures 56, 57, and 58 extending transversely through the aligned plates. U-shaped bar member 60 is pivotally secured to brackets 54 and 55 on its outer ends 61 and 62 by pins or pintles which in one embodiment are clevis pins which are passed through apertures 56 in brackets 54 and 55 and aligned apertures near outer ends 61 and 62. In addition, one end of straight bar member or arm 64 is pivotally secured to bracket 54 also by a pin or pintle passed through aperture 58 and an aligned aperture in arm 64, and similarly another straight bar member or arm 66 is pivotally secured on one end to bracket 55 by a pin or pintle passed through apertures 58 and an aligned aperture in arm 66. Bars 64 and 66 may be pivotally secured to brackets 54 and 55 via apertures 57 rather than apertures 58 if it is desired to change the angle of the lift position of chair 10 slightly.

Chair assembly support structure 68 is pivotally connected both to U-shaped bar 60 as well as to the ends of straight bars 64 and 66 opposite links 58. More particularly, chair assembly support structure 68 includes an upright or vertical C-shaped bar section 70 having its ends facing generally downwardly in the position shown in FIG. 4, and a pair of opposed horizontal C-shaped bar sections 72 and 74 having their ends oriented facing outwardly with respect to bar section 70, and each being connected by welding to one of the ends of bar section 70 at a forward position on the length of the C-shaped bar sections 72 and 74. The bar sections of chair support structure 68 are also all preferably made of hollow rectangular steel bars. A small bracket 71 as well as a larger bracket 73 are connected to bar section 70 the purpose of which brackets is explained below. In one embodiment a pair of short reinforcing members or braces 76 and 77 are secured by welding to the juncture of C-shaped bar sections 70-72 and 70-74, respectively.

C-shaped bar section 70 of chair assembly support structure 68 is pivotally connected near its downwardly facing ends to U-shaped bar 60. In addition, straight bar 64 is pivotally connected to reinforcing member 76 attached to C-bar sections 70 and 72, while straight bar 66 is similarly pivotally connected to reinforcing member 77 attached to C-bar sections 70 and 74. Suitable spacers may be provided between the pivotable connections to help maintain the connections and frame members in proper alignment. As shown in FIG. 2, C-shaped bar sections 72 and 74 serve as supports for the arm frames 24 and 25, respectively, when the chair assembly 16 is moved into a lift position. More particularly, orifices 78 which are visible in FIGS. 4 and 6 extend through the upper and lower surface of bar sections 72 and 74 so that a securing member such as a screw or the like may be passed through apertures 78 and the underside 36 of arm frames 24 and 25, to secure them together.

An actuator bracket 80 is connected to rear crossbar 48 of base frame 12 at a position spaced from the ends of rear crossbar 48 and between parallel bars 49 and 50, to which bracket 80 of chair lift and recline actuator 82 is pivotally attached. Actuator 82 may be any type of actuator including but not limited to electric, gas, and hydraulic actuators. Suitable actuators are the Omegadrive™ linear actuators commercially available from OkinGmbH & Co. KG located in Gummersbach, Germany, model numbers OS2-SW-394-212 and OZ-SW-330-221. In one embodiment actuator 82 includes a reversible electric motor 84, an outer tube member or sleeve 86 which projects outwardly from the motor housing, and a spindle or rod 88 which is telescopingly movable in sleeve 86 as a result of the operation of the reversible motor 84 so as to increase and decrease the combined overall length of sleeve 86 and spindle 88, and thereby to adjust the position of objects or structures connected to the end of such threaded sleeve and spindle arrangement. An engaging member 90 (see FIG. 6) is provided on the outer end of the actuator housing, which engaging member 90 is used to pivotally connect actuator 82 to base frame actuator bracket 80 by a pin or pintle 91.

In addition, another engaging member or aperture 92 is provided on the distal end of spindle or rod 88, which enables the spindle or rod 88 to be pivotally connected to a bell crank 94 by a pin or pintle 93. More particularly, as best shown in FIGS. 4 and 5 bell crank 94 includes a pair of identical or matching spaced apart plates 95 and 96, each having a first through-aperture 98 situated near one end, a second through-aperture 99 situated near the opposite end, and a third aperture 100 situated between apertures 98 and 99. In the exemplary embodiment, edge 101 in a side surface of plates 95 and 96 is inwardly angled starting on the end closest to second through-aperture 99, forming a lip 102, while another edge 104 on the opposite side of plates 95 and 96 from edge 101 is outwardly angled starting from the end near first through-aperture 98. As shown in FIGS. 4-6, engaging member or aperture 92 in rod 88 of actuator 82 is pivotally connected to bell crank 94 by passing a pin or pintle 93 through apertures 100 and aligned apertures in engaging member or aperture 92.

Figure 3:
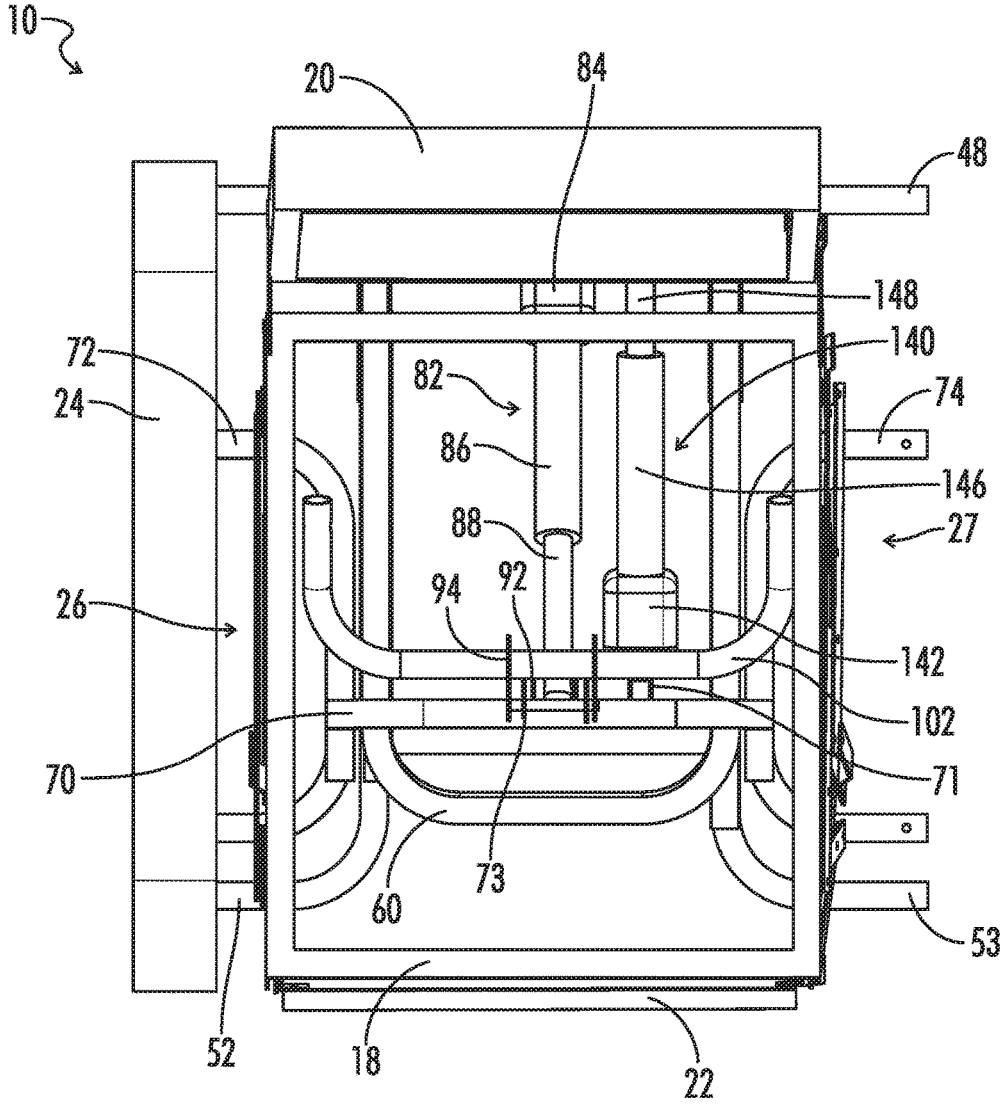
FIG. 3 is a top view of the chair in the position shown in FIGS. 1 and 2.

In addition, as shown in FIG. 3, bell crank 94 is pivotally connected to bracket 73 on upright C-shaped section 70 of chair assembly support structure 68 by a pin or pintle passed through aligned apertures in bracket 73 and aligned apertures 99 in plates 95 and 96 of the bell crank 94. As best shown in FIGS. 1 and 3, a C-shaped bar 102 is pivotally secured on its ends to the inwardly facing surface 42 of side sections 30 and 31 of seat frame 18, in one embodiment approximately one-third of the way from front member 28. Bracket member 104 having a pair of aligned apertures 106 is connected by welding to C-shaped bar 102 at a position aligned with bell crank 94, and such bell crank 94 is connected to C-shaped bar 102 by passing a pin or pintle through aligned apertures 106 in bracket member 104 on C-shaped bar 102 and apertures 98 in plates 95 and 96 of bell crank 94. Expansion lengthening or shortening of actuator 82 is transmitted through bell crank 94 to C shaped bar 102 and hence to the chair assembly 16.

Recliner linkage mechanisms 26 and 27 pivotally connect the seat frame 18, footrest 22, and arm frames 24 together, as described below, and in the illustrated embodiment also connect to back frame 20, providing a comprehensive and interconnected chair assembly 16. The details of recliner linkage mechanisms 26 and 27 will now be described with particular reference to FIG. 2. It will be understood that the recliner mechanism 27 shown in FIG. 2 is designed to be placed on the left side of the chair, or the right side of chair 10 when viewed from the front, and further that the right side or the left side (when chair 10 is viewed from the front) of recliner mechanism 26 is comprised of identical operative parts arranged in mirror image. It will also be understood that chair 10 may except where specifically indicated utilize other recliner mechanisms known in the prior art, including adaptations of known two-way and three-way mechanisms, and that the invention is not meant to be limited to use only with the described recliner mechanism.

Recliner mechanism 27 includes an elongated arm frame connector plate 110 that is secured to the inner side surface of side section 40 of left arm frame 24 (not shown) preferably by bolts or screws which are passed through several spaced-apart apertures 111 on plate 110. A spacer block, not shown, may be provided between connector plate 110 and arm frame side section 40 of the left arm frame to accommodate use of frames having different sizes or dimensions. In addition, depending on the desired angle of the recliner mechanisms 26, 27 with respect to the seat frame 26, the recliner mechanisms may be attached to the seat frame 26 at a slight angle. Link 112 is pivotally connected at 113 to arm frame connector plate 110 near the forward end of such plate 110, and is also pivotally connected on its other end to seat frame connector plate 114, which is secured to the outer surface 43 of seat frame side member 31, at 115. Link 116 also pivotally connects between arm frame connector plate 110 and seat frame connector plate 114, and is pivotally connected to arm frame connector plate 110 at 117 and to seat frame connector plate 114 at 118. Meanwhile, link 120 is also pivotally secured on one end to arm frame connector plate 110 at 113, and another link 122 is pivotally secured to the forward end of seat frame connector plate 114 at 123. Angled link 124 is pivotally secured on one end to the end of link 120 at 125, and is also pivotally secured to link 122 at 127. Straight link 128 is secured on one end to the end of link 122 at 129. Links 124 and 128 are pivotally secured to footrest frame 130 at 131 and 133, respectively. Finally, footrest 22 is also secured to footrest frame 130. In addition, first L-link 132 is secured to seat frame side member 31 extending upwardly. One arm of L-shaped link 47 is pivotally secured at 135 to straight link 132, and the other arm of L-shaped link 47 is connected to side member 35 of arm frame 20 at 138 and 139.

As shown in FIG.6, a second actuator mechanism is also provided, namely back frame actuator 140, which in one embodiment is comprised of a second reversible electric motor 142 having an engaging member 144 on the rear end of the motor housing, an outer tube member or sleeve 146 which projects outwardly from the motor housing, and a spindle or rod 148 which rod is telescopingly movable in sleeve 146 as a result of the operation of the reversible motor 142 to increase and decrease their combined overall length, and having an engaging member or aperture 150 on the distal end of spindle or rod 148. Back frame actuator 140 is situated so that it can lie or rest essentially side-by-side with lift and recline actuator 82. Engaging member 144 on the outer side of the housing for motor 142 of actuator 140 is pivotally connected to bracket 71 of C-shaped bar section 70 forming part of the lift frame 68 by a pin or pintle 143. In addition, as shown in FIG. 2, engaging member 150 on sleeve 148 is pivotally secured to back frame 20 via seat back motor attaching bar 152 (see FIG. 1). Bar 152 in an embodiment is comprised of hollow rectangular steel bar having plates 154 and 156 welded to its ends. In one embodiment, plates 154 and 156 have cutout sections, not shown, which facilitate attachment to the inner sides 44 of side sections 34 and 35 of back frame 20. Preferably, plate 154 is bolted or otherwise secured to side section 34 in combination with L-shaped back frame connector link 47 on the outer surface 45 of side section 34, while plate 156 is similarly bolted to side section 35 in combination with L-shaped back frame connector link 47 also on the outer surface 45 of side section 35. As shown in FIG. 2, short extension bar member 158 is rigidly connected preferably by welding extending downwardly from bar 152 at a position aligned with actuator 140, and a ring member or other connector is secured to the lower end of extension bar 158, to which engaging member 150 is pivotally connected via a pin 151. A controller 160, shown in FIG. 11 and described in greater detail below, is operably connected to both lift and recline actuator 82 and back frame actuator 140, and is used to manually operate and synchronously control such actuators and therefore the movements of the chair 10.

The incline position of the back frame 20 can be adjusted by operating controller 160 to extend and retract spindle 148, which spindle 148 as indicated above is telescopingly movable in sleeve 146 of reversible electric actuator 148, which is connected between the lift frame 68 and back frame 20. More particularly, actuator 140 is connected to bracket 71 of C-shaped bar 70 of lift frame 68 on one end and to bar 158 connected to bar 152 attached to seat frame 20 on its opposite end. In U.S. Pat. No. 7,543,885 and its copending applications owned by the Applicant, the inventors provide a lift and/or recline chair in which the angle or incline of the back frame is independently adjustable, without requiring movement of the seat frame or footrest. In order to accomplish this independent movement, however, the back frame actuator must be connected directly between the back frame and the seat frame, or between the back frame and a component of the chair that follows or moves as the seat frame is moved using the lift/recline actuator. Although the back frame actuator in such prior art arrangement does not have to be connected to the seat frame directly, the back frame actuator must be connected to a component of the chair that moves with and remains in substantially the same relative position with respect to the seat frame as the chair, with the connection being pivotable so that the angle of the back frame actuator can vary with respect to the seat frame. Thus, the back frame actuator could also be connected between the back frame and a chair component such as the bell crank, or C-shaped bar attached directly to the seat frame, or another component that moves with and remains in substantially the same position with respect to with the seat frame as the lift/recline actuator is operated.

The previous arrangement provided for the first time a lift chair and recliner having a truly independently adjustable back frame or back section. In some circumstances, however, particularly given the limited amount of space available within the confines or dimensions of the chair assembly, it might be desirable to vary the position of the back frame actuator, particularly if one or more additional features such as an independently adjustable footrest, heater assembly, rocker assembly, massage, or different base configurations such as a wall hugger type chair, and the like are to be accommodated. In this regard the present inventors have now unexpectedly realized that by synchronizing the operation of the lift/recline and back frame actuators, the back frame actuator can be attached to other components or parts of the chair such as the lift assembly that remain stationary when the back frame actuator is adjusted, while still providing an independently adjustable back frame within its full range of motion without regard to the position of the chair assembly.

Figure 7:
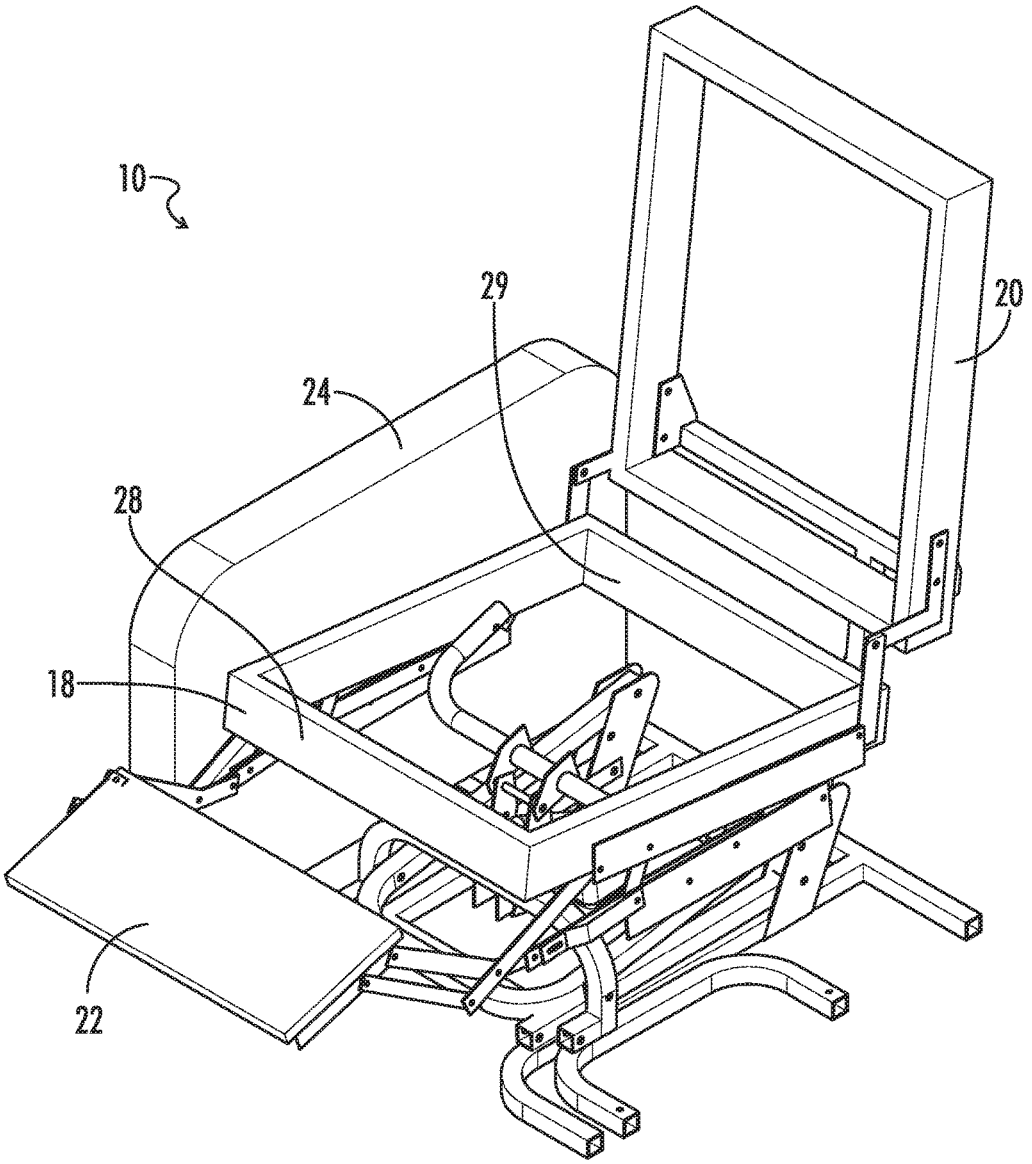
FIG. 7 is a perspective view of the chair in a reclining position.
Figure 8:
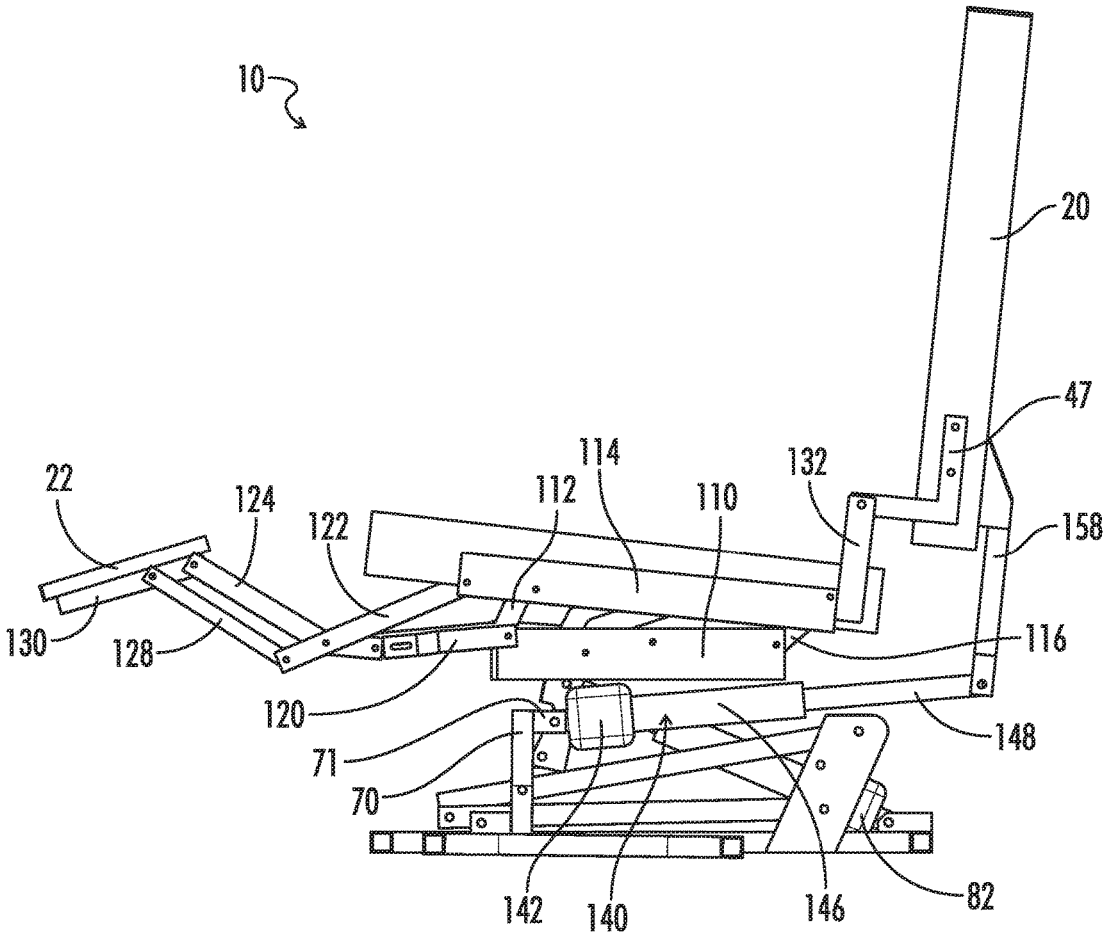
FIG. 8 is a side elevation view of the chair in the position shown in FIG. 7.

FIGS. 7 and 8 illustrate chair 10 with the footrest 22 having been pivoted or moved from the normal seated position or "home" position in FIG. 1 to an extended position. This is accomplished by activating the lift/recline actuator 82 using hand controller 160 (see FIG. 11) to further retract spindle 88 into sleeve 86, which causes bell crank 94 to be pulled rearwardly. As a result, seat frame 18 is also pulled rearwardly due to its connection to the bell crank 94 via C-shaped bar 102. As seat frame 18 is being pulled rearwardly by the combination of bell crank 94 and C-bar 102, links 112 and 116 which connect between arm frame connector plate 110 and seat frame connector plate 114 of linkage mechanisms 26 and 27 pivot rearwardly, causing seat frame 18 to pivot rearwardly. In addition, in the illustrated embodiment rear member 29 of seat frame 18 is lowered slightly as link 116 pivots beyond a vertical position, so that seat frame 18 becomes slightly negatively or rearwardly angled from front member 28 to rear member 29. As seat frame 18 is pivoted rearwardly, links 120 and 122 are caused to pivot forwardly and upwardly. This causes links 124 and 128 supporting footrest frame 130 to be extended outwardly, and footrest frame 130 and footrest 22 to be moved and pivoted into an extended position. The slight rearward angle of seat frame 18 and slight forward angle of footrest 22 is considered a comfortable sitting position because it allows for a slight natural bend in the knees of the user sitting in chair 10.

The rearward pivoting or reclining movement of seat frame 18 on links 112 and 116 as shown in FIGS. 7 and 8 would be opposed by the attachment of back frame actuator 140 between downwardly extending back frame bar 158 and connector 71 attached to C-shaped bar 70 of lift frame mechanism 68, which remains stationary as the chair is being moved to a reclining position. This is because spindle 148 of actuator 140 is extended from sleeve 146 a specific distance to hold back frame 120 at a certain angle or position. However, since the seat frame 18 is moved rearwardly and angled slightly downwardly during reclining, back frame 20 will also be urged to follow this same movement. This resulting movement also changes the total distance between connector 71 on stationary C-shaped bar 70 of lift frame mechanism 68 and back frame bar 158. In order for the seat frame 18 and back frame 20 to move rearwardly in unison in response to recliner actuator mechanism 82, the operation of actuators 82 and 140 therefore must be synchronized. Thus, when actuator 82 is operated to move chair 10 into a reclining position, at a point when seat frame 18 begins to pivot rearwardly on links 112 and 116, spindle 148 of back frame actuator 140 is synchronized via a control system associated with the actuators and operated by a control means such as controller 160 to extend further from sleeve 146 a distance which is essentially equal to the length of rearward movement of seat frame 18, to allow for the increased distance between connector 71 and back frame bar 158 between which actuator 140 is connected. Further, when chair 10 is returned from a reclining position to a fully upright or "home" position by actuator mechanism 82, seat frame 18 is pivoted forwardly on links 112 and 116, at which point back frame actuator 140 is retracted an amount sufficient to compensate for the reduced distance between connector 71 and back frame bar 158 between which actuator 140 is connected. Since the back frame actuator 140 is attached to the lift frame assembly which rises up as the chair is being lifted, and the distance between the back frame 20 and connector 71 does vary as the chair assembly is being lifted, the back motor 142 does not have to activate in order for the chair to lift.

In order to provide for the synchronized movement of actuators 82 and 140 when the chair 10 is reclining to allow the chair to fully recline, and also to allow the back frame to be independently movable through a full range of motion, the stroke length of actuator 140 must be increased. Thus, when chair 10 is in a "home" or upright position, rather than spindle 148 of actuator 140 being fully extended the actuator will be arranged such that spindle 148 can be further extended to compensate for the rearward movement of seat frame 18. In an exemplary embodiment, the stroke length required for the back frame actuator to move the back frame through its full range of motion is five inches, and the stroke length required to compensate for the movement of seat frame during reclining is three and seven-eighths inches. Therefore, the total required stroke length of the back frame actuator is eight and seven-eighths inches, and when the chair is in an upright or "home" position the spindle 148 will already be retracted three and seven-eighths inches rather than being fully extended. One result of such increased stroke length to allow the back to travel with the seat when the recline/lift motor is operated is that when the back frame is operated independent of the seat frame, the total range of motion of the back frame is increased. As a result, the back frame could be activated to move past a vertical or 90° position to a position about 15° degrees past forward. Since this is not considered a desirable position and also could cause the motor to bind up against the bottom of the seat frame, in one embodiment actuator 160 is programmed to activate a micro switch to prevent the back frame from traveling past a vertical position or other defined position, if the footrest is part way open to all the way up in the lift position. In another embodiment, the range of motion or movement of the back frame may be further restricted when the chair is in a lift position.

Figure 9:
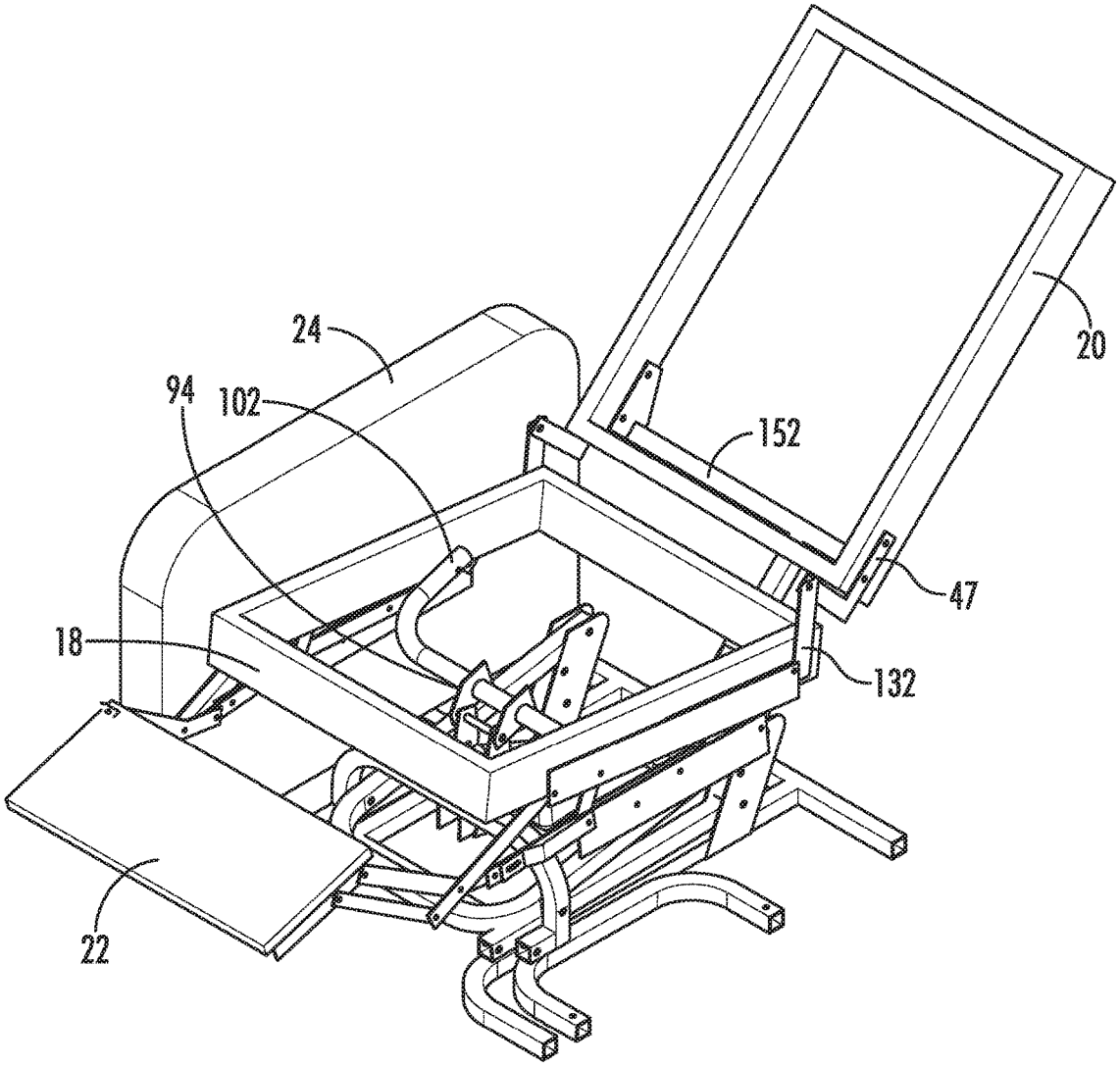
FIG. 9 is a perspective view of the chair in another reclining position.
Figure 10:
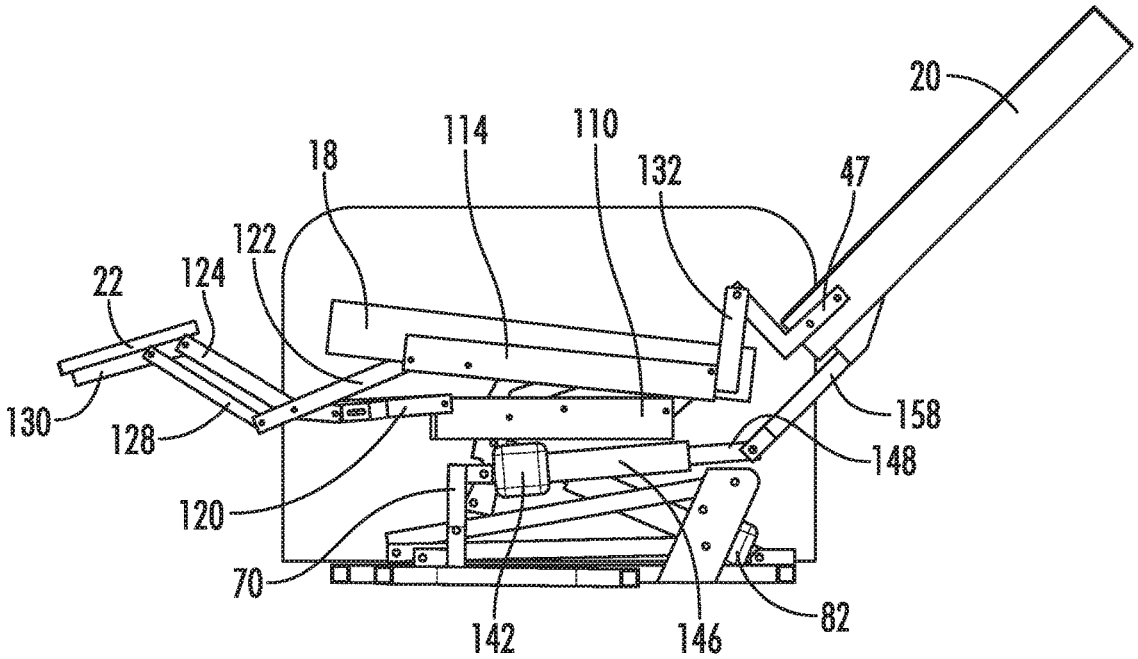
FIG. 10 is a side elevation view of the chair in the position shown in FIG. 9.

FIGS. 9 and 10 illustrate chair 10 with footrest 22 in the same elevated position as in FIGS. 8 and 9, and in addition with back frame 20 pivoted from a substantially vertical or slightly rearwardly angled position to an approximately forty five degree angle with respect to horizontal. Back frame 20 is pivoted with respect to the seat frame by back frame actuator 140 using controller 160 by retracting spindle 148 of actuator 140 further into sleeve 146, which pulls the lower end of short bar 158 inwardly and causes bar 152 to pull seat frame 20 rearwardly and downwardly so as to pivot the seat frame 20 on links 47. Seat frame 18 and footrest 22 remain stationary as back frame 20 is pivoted.

Figure 11:
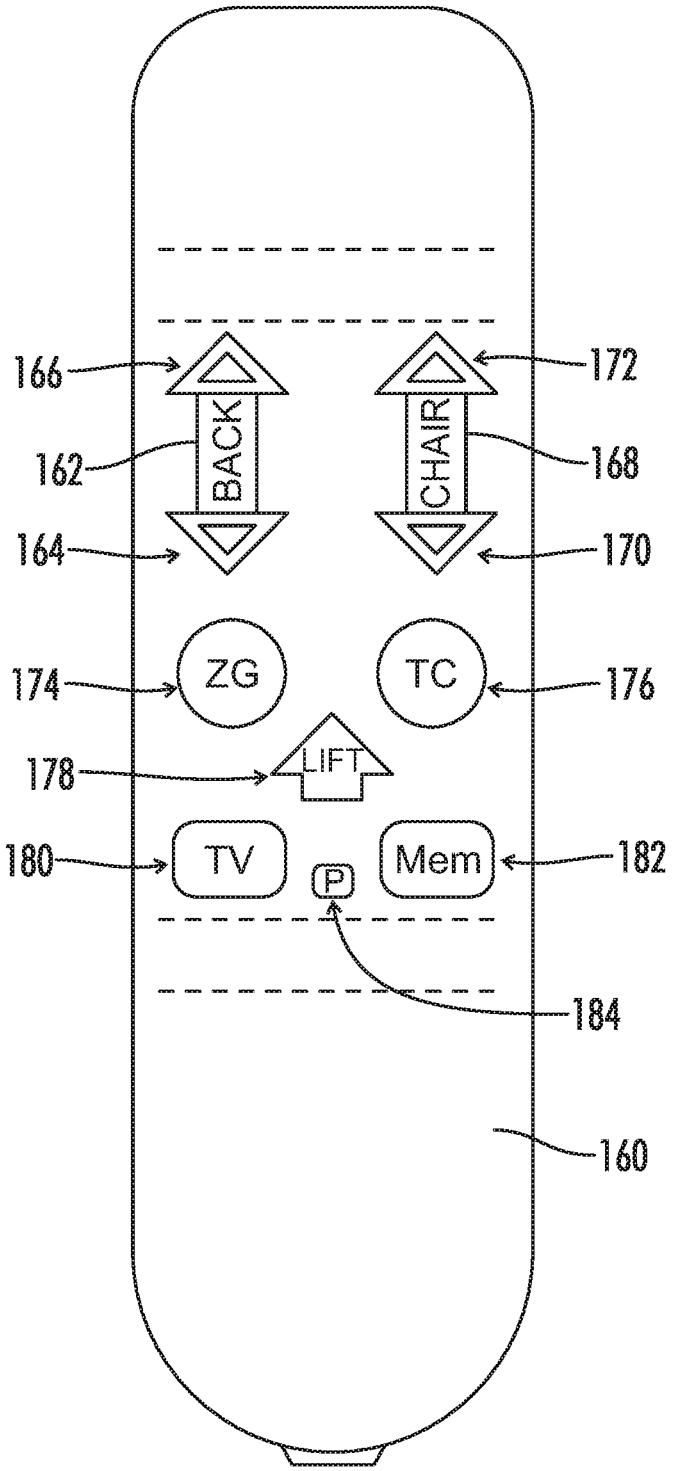
FIG. 11 is a front view of an exemplary controller apparatus used for controlling the movements and position of the actuators.

FIG. 11 illustrates the front surface or face of an exemplary controller 160, which has been programmed to either separately or synchronously control actuators 82 and 140. More particularly, in the exemplary embodiment controller 160 includes a chair back control button 162 having a first arrow 164 and second arrow 166, a chair control button 168 also having a first arrow 170 and a second arrow 172, a "zero gravity" position button 174, a TC position button 176, a Lift button 178, a "TV position" button 180, a memory button 182, and a programming button 184. Hand control 160 is programmed to control the actuators using a programming language used to program an integrated circuit, which in one embodiment may be accomplished using a PIC (Peripheral Interface Controller) which stores a control program that may be in binary code, whereby the PIC saves the programmed information as it needs to change output pins according to what is received from input pins, which in turn drives the actuators. Thus, in a typical embodiment the actuators are controlled by a programmed solid state device. In the embodiment shown, pressing down and holding second arrow 166 of back control button 162 will cause the back frame of the chair to recline or move in a first direction without any movement of the chair seat or footrest until the back frame reaches the desired position, after which the user will release the button. Pressing and holding first arrow 164 of back control button 162 will cause the back frame to move in the opposite direction, also independent of or without any movement of the chair seat or footrest, until the desired position is reached and the button is released, or until the back frame has reached the end of its range of motion in such direction. Thus, where second arrow 166 reclines the back frame, to move the back of the chair to an upright position, first arrow 164 is pressed and held until the back reaches the desired position, after which the button is released.

Pressing and holding arrow button 170 of chair button 168 will open or raise the footrest and seat of the chair until it reaches the desired position, after which button 170 is released. To lower the footrest and seat, arrow button 172 of chair control button 168 is pressed and held until the footrest closes. If the user wishes to move the chair into a lift position, the user can continue to hold arrow button 172 until the desired height or lift position is reached, after which the button is released. To lower the chair from a lift or raised position, the user can press and hold chair arrow button 170 until the chair reaches the floor, after which button 170 is released. From the lifted position, the user can also press and buttons 174, 176, 180, or 182 and the chair will move from a lift position to these preprogrammed positions, as discussed below. Pressing button 174 causes the chair to move to a "zero gravity" reclining position by synchronously activating and controlling actuators 80 and 140. Pressing button 176 similarly causes the chair to move to a "TC" or "total comfort" position also by synchronously activating and controlling actuators 80 and 140. In one embodiment, to reach a "total comfort" position the seat frame or box is raised upwardly, which creates a neutral lower body posture, while the back section stays at the same angle as in the preprogrammed tv position 180. To close and lift the chair from a reclined/seated position (footrest up, back down), lift button 178 can be pressed. To bring the chair to a seated position from a reclining position using lift button 178, the user can hold the button until the footrest closes, and then release the button. Button 166 can also be pressed to bring the back the rest of the way up from a reclining position to a seated position. To close and lift the chair, the user can hold down the lift button 178 until the chair stops. The motors of the actuators are programmed to automatically shut off when the back closes and the chair reaches its highest position.

For a user to get into the lift chair while it is in a raised or lift position, while standing next to the chair, lift button 178 is pressed to raise the chair to a desired height the user can sit against. This height will vary from person to person depending on the individual's needs. The chair should be raised high enough so the user does not have to fall or flop down into the chair. Once the user has entered the chair, the chair down arrow button 170 is then pressed to lower the chair. As the chair continues downward, the user should adjust his or her position to be comfortable, holding button 170 down until the chair is firmly on the floor in a seated position, and then releasing the button. The user can then operate one of the other buttons to move the chair into a desired reclining position, or stay in an upright or floor position. For a user to exit or get out of the lift chair, lift button 178 is pressed to raise the chair into a lift position, holding the button until the chair is raised to a height that enables the user to easily stand, and then releasing the button. After getting out the chair, the chair should be returned to a seated position in which the chair is firmly on the floor, so that children, pets or obstructions do not get under the chair.

In a preferred embodiment, the lift/recline and back frame motors are set or programmed to shut off automatically when they reach their fully extended or fully retracted position if the selected button is not released. If the user moves the chair past a desired position, the button to bring the user back to the desired position is selected as needed. Buttons 180 and 182 are programmable and can be programmed to move the chair to a desired position. Button 180 in one embodiment is preprogrammed so that when pressed the chair is moved to a comfortable television watching position from any other position having an ergonomic upper body position that minimizes neck strain, while button 182 may be programmed to cause the chair to be moved to another desired position the user may wish to easily reach repeatably. To program or reprogram one of buttons 180 and 182, after the chair is moved to a desired position, the program button 184 is pressed and held, which causes a back light to go off. In one embodiment, after holding program button 184 for about three seconds, the back light will flash. The user then will have five seconds to press either button 180 or 182 to save the position. The back light will return to a non-flashing state once the position is stored. If a programmable memory button is not pressed within five seconds, or a different button is pressed, then the programming sequence is aborted and the user will need to repeat the programming steps. In another embodiment, hand control 160 may be disabled by pressing a combination of buttons, while in still another embodiment hand control 160 includes a controlled function lock wherein when a predetermined code sequence of buttons is pressed, all but the lift and standard recline buttons are disabled. The function lock feature is provided in particular for users having a limited metal ability who may become confused by more than only the most basic controls, and is designed to prevent such persons from inadvertently becoming stuck in a position they cannot figure out how to get out of. In another embodiment, hand control 160 is programmed so that when a sequence of buttons are entered, the control is reset to its factory settings. In still another embodiment, hand control 160 includes zero gravity, tv viewing, sit, and sleep buttons, which buttons are programmed to move the chair to corresponding positions.

In the presently described embodiment, the chair is described as being a lift and recline chair in which the back frame actuator is connected between the back frame and a stationary position on the lift frame of the chair. As a practical matter, the position at which the back frame actuator is connected to the lift frame must be spaced apart from the back frame connection a sufficient distance for the actuator to fit in such space, although different sized actuators or spindles can be utilized. In another embodiment, the chair may also be a recliner, in which the back frame actuator is connected between the back frame and a stationary position on the base frame or recline mechanism for the chair, while still falling within the intended scope of the invention.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A recliner chair having a base frame for supporting the chair on a floor comprising:

(a) a recline assembly connected to the chair base frame, (a) a seat frame connected to the recline assembly, (b) a pair of armrests, (c) a pair of recliner linkage mechanisms each connected to opposite sides of the seat frame and to one of the armrests, (d) a pivoting footrest operably connected to a pantograph linkage, (e) a back frame which is pivotable with respect to the seat frame, (f) a recline actuator mechanism operably coupled to the recline assembly for moving the chair between an upright or seated position and a reclining position, (g) a back frame actuator mechanism for adjusting the inclination of the back frame without requiring any movement of the seat frame, said back frame actuator mechanism operably coupled between the back frame and a position on the base frame or recline assembly that remains stationary when the chair is moved between an upright position and any reclining position using the recline actuator mechanism, and (h) a hand control for operating and controlling said recline and back frame actuator mechanisms, such that as the recline actuator mechanism is activated the back frame actuator is simultaneously activated in order to compensate for changes in distance between the connection points of the back frame actuator with the back frame and base frame or recline assembly.

2. The recliner chair of claim 1 in which the recline assembly is a combination lift and recline assembly including a lift frame, and whereby the back frame actuator may additionally be connected by linkages between the back frame and a position on the lift frame that remains stationary when the recliner actuator mechanism is activated to move the chair between an upright position and reclining position.

3. The recliner chair of claim 2 in which said hand control additionally comprises a plurality of buttons which are programmed or programmable to at least pivot said back frame without requiring any movement of the seat frame, and for moving said chair between a lift position and a reclining position.

4. The recliner of claim 3 in which at least one of said plurality of buttons is programmed to move said chair into a specific reclining position.

5. The recliner of claim 4 in which said hand control may be programmed to disable one or more of said plurality of buttons programmed for moving the chair into a specific reclining position.

6. The recliner chair of claim 5 in which the chair is positionable in both a Trendelenburg and zero-gravity position.

7. The recliner chair of claim 2 in which the lift and recline assembly includes an upright C-shaped bar having a connector means to which the back frame actuator is pivotally connected.

8. The recliner chair of claim 7 in which the stroke length of the back frame actuator is increased an amount equal to the distance of movement of the seat frame upon the chair being moved between an upright position and a fully reclined position.

9. A lift and recliner chair comprising:

(a) a base frame for supporting the chair on a support surface, (b) a lift and recline assembly connected to the base frame, (c) a chair assembly connected to the lift and recline assembly, said chair assembly including a seat frame, a back frame which is pivotable with respect to the seat frame, a footrest, a pair of arm frames, and a pair of recliner linkage mechanisms each connected between opposite sides of the seat frame and one of the arm frames, (d) a lift and recline actuator mechanism operably coupled to the lift and recline assembly for moving the chair between upright, lift, and reclining positions, (e) a back frame actuator mechanism configured to adjust the inclination of the back frame with respect to the seat frame without any change of position of the seat frame or footrest, said back frame actuator mechanism operably coupled by linkages between the back frame and a component of the base frame or lift and recline assembly that remains stationary when the recline actuator mechanism is operated to move the chair between an upright position and any reclining position, and (f) a control system operably connected to a hand controller and to the lift and recline and back frame actuator mechanisms, said control system configured to synchronously activate and control said back frame actuator mechanism to compensate for changes in distance between said back frame actuator mechanism linkages as the chair is moved between an upright position and a reclining position by operation of the lift and recline actuator mechanism.

10. The lift and recliner chair of claim 9 in which said back frame actuator mechanism has a greater stroke length than said lift and recline actuator mechanism, which difference in stroke length is at least equal to the change in distance between said back frame actuator linkages during movement of the chair being moved between an upright position and a fully reclining position.

11. The lift and recliner chair of claim 10 additionally comprising a chair assembly support structure including an upright bar section and a pair of chair assembly arm frame support sections connected to opposite ends of the upright bar section, a first bracket connected to said upright bar section for pivotably receiving a bell crank, and a said bracket connected to said upright bar section for pivotably receiving an end of said back frame actuator mechanism.

12. The lift and recliner chair of claim 11 in which when the chair is in an upright position the back frame actuator mechanism is positioned at less than a fully extended position.

* * * * *